United States Patent [19]

Matlen

[11] Patent Number: 4,818,849

[45] Date of Patent: Apr. 4, 1989

[54] SHIELDED LAMP UNIT

[76] Inventor: Abraham J. Matlen, 15378 Livernois, Detroit, Mich. 48238

[21] Appl. No.: 72,549

[22] Filed: Jul. 13, 1987

[51] Int. Cl.[4] ..... F24H 3/00

[52] U.S. Cl. ..... 219/354; 219/357

[58] Field of Search ..... 219/342, 343, 353, 354, 219/357; 313/493, 312, 324; 362/377, 223

[56] References Cited

U.S. PATENT DOCUMENTS

| | | | |
|---|---|---|---|
| 3,596,057 | 7/1971 | Arntz | 219/354 |
| 3,673,401 | 6/1972 | DuPont | 313/312 X |
| 4,241,292 | 12/1980 | Kreick et al. | 219/354 X |
| 4,324,126 | 4/1982 | Riech et al. | 219/354 |
| 4,406,944 | 9/1983 | Crain et al. | 219/357 X |

*Primary Examiner*—C. L. Albritton

*Attorney, Agent, or Firm*—Cullen, Sloman, Cantor, Grauer, Scott & Rutherford

[57] ABSTRACT

A shielded lamp unit for use in applications where a standard quartz lamp is susceptible to damage by contaminants. The unit includes a transparent substantially tubular sheath member having caps at opposite ends for supporting the lamp in a concentrically spaced relationship to the inner walls of the sheath and for sealing contaminants out of the lamp area. The end caps include a longitudinal bore which receives the quartz-type lamp and at least one concentric annular flange which is received in the inner bore of the tubular member.

3 Claims, 1 Drawing Sheet

SHIELDED LAMP UNIT

BACKGROUND OF THE INVENTION

The present invention relates to a shielded heating lamp unit having a shield for use in protecting quartz or quartz-type lamps from damaging contaminants. More particularly, the present invention relates to a transparent tubular sheath of high temperature resistant material, such as for example quartz, within which a complementary-shaped quartz lamp is suspended in concentric spaced relationship to the inner walls of the sheath. The sheath permits handling of the quartz lamp without fear of depositing splatter and or contaminants, etc. on the lamp's outer surface and, more importantly, permits the quartz-type lamp to be used as an element in a heating device, such as for example a heating device for cooking and/or broiling foods.

Quartz-type lamps generate substantial amounts of heat and are typically useful for heating and lighting purposes. A typical quartz-type heat lamp can generate up to 4500° Fahrenheit and develop from 300 to 5000 watts with an efficiency of 93%. This heat is almost instantly generated after the lamp is energized. However, quartz-type lamps are easily damaged by the deposit of contaminants on the lamp's surface which limits their usefulness.

In most cases, Nichrome wire elements in a metal sheath are generally used in heating and cooking applications. Some elements are formed by inserting a section of nichrome wire into an outer metal casing and then packing the casing with magnesium oxide to insulate the wire from the casing. The unit is then swedged through a machine to approximately ⅜ inch to ⅜ inch in diameter. This compresses the casing and insulating material about the wire. Other methods of using bare Nichrome wires for heating elements have limitations also. The wire is dangerous and caution must be used to prevent being burnt or electrocuted.

Nichrome wire elements only generate approximately 1600° Fahrenheit with an efficiency of approximately 43%. Further, there is a considerable time lag to peak temperature when compared to the quartz-type lamp which is almost instantaneously develops peak temperature. When compared, a quartz-type lamp is greatly superior to the nichrome wire element in heating and cooking applications. The major problems with quartz-type lamps is their sensitivity to contaminants and extreme fragility.

When using quartz-type lamps, special care must be exercised to prevent deposits on the lamp's outer surface. Generally, clean cotton gloves or other protective means must be used when handling the lamps to prevent oil or grease from the person's hands from being deposited on the lamps. Deposits of oil, grease, or other contaminants on the lamp's outer surface can substantially reduce the lamp's life. For example, a typical quartz lamp may operate for approximately 5000 hours at rated voltages if it is handled properly. Should the surface of the quartz lamp be contaminated, it may last for a substantially less useful life.

SUMMARY OF THE INVENTION

Applicant's invention overcomes the disadvantages of quartz-type lamps by providing a shielding device which facilitates handling and use of the lamp. The protective device of the present invention includes an elongated, substantially tubular member made of high temperature resistant material which is complmentary in shape to the quartz-type lamp. The tube has an inner diameter which is greater than the outer diameter of the lamp so that the lamp may be mounted in concentric spaced relationship to the inner walls of the tubular member.

In the preferred embodiment, support caps of high temperature plastic, such as for exmaple Teflon or ceramic, are provided for supporting the lamp in spaced relationship to the inner wall of the tubular member. Each support has first and second laterally spaced faces with a longitudinal bore extending through these faces. The bore is concentric with the tubular member and has first and second portions with the first portion being larger in diameter than the second portion. The first portion receives the end of the lamp with any electrical connections extending through the second portion.

An annular flange is integrally formed on the cap adjacent the end of the tubular member. The flange has an outer diameter which is substantially equal to the inner diameter of the tubular member. In this manner, the end caps can be placed in the ends of the tubular member and receive the end of the quartz-type lamp to suspend the lamp in spaced concentric relationship to the inner wall of the tubular member. Further, the end caps seal the ends of the tubular member preventing contaminants from getting inside the tubular member.

In the preferred embodiment, the tubular member is made of quartz. The quartz is believed by Applicant to be the most efficient material because of its ability to withstand the intense heat generated by the lamp and because of its exceptional transmissivity of infrared wavelengths.

As defined, the protective device of the present invention provides two benefits. First, it permits easier handling of the quartz-type lamp. Since all contaminants will be deposited on the exterior of the tubular member or sheath, the contaminants are not deposited on the quartz-type lamp. Second, it permits the quartz-type lamp to be mounted closely adjacent to an object to be heated, such as for exmaple food which is to be prepared or cooked. Because of the closeness of the lamp, a substantial amount of the available heat from the lamp is transferred to the object.

A further aspect of the present invention involves the mounting of the protective device which includes specially configured mounting brackets and heat insulation means. Each bracket has a body portion and at least one leg having a semicircular slot for receipt of the support caps. The brackets are resilient. A second annular flange is provided on the support cap opposite the first flange for insertion into the slot with the outer diameter of the second annular flange being substantially equal to the inner diameter of the slot.

The insulating means has two opposed walls with spaced openings through each wall. The openings are horizontally aligned for receipt of the tubular members and lamps such that the ends of both and the support caps protrude through the walls. The mounting brackets are attached to the protruding side of the wall and bias the support caps against the tubular member. The protruding side of the walls is preferably air cooled to keep the ends of the lamp unit below 600° F. which is the manufacturer's rated seal specifications.

The present invention provides particular advantages in all applications of quartz-type lamps. Further, the present invention can be used in applications where quartz-type lamps were previously not acceptable, such as for example, in the preparation of foods, particularly meats. Because of the highly intense heat provided by the lamp and the ability to place the lamp in close proximity to the food, the food cooks quickly and efficiently while retaining natural juices. The present invention has been found to be particularly useful in automatic ovens of the type disclosed in applicant's U.S. Pat. No. 3,882,766, issued May 13, 1975, and entitled "Automatic Oven". U.S. Pat. No. 3,882,766 is included herein by reference The disclosed oven automatically broils and self-bastes foods between opposed heating members. A rotatable food retainer is provided which is driven by a drive system which continuously rotates the food retainer for self-basting of the food in its own juices and for selectively raising and lowering the food retainer between the cooking station and a rest station. The food retainer is formed as a lateral gridwork of ribs with open spaces therebetween, the spaces between the grids exposing the food to the heating elements. The invention contemplates positioning the food as close to the heaters as possible and still permit rotation of the retainer. The present lamp unit adapts particularly well to use in the oven.

DETAILED DESCRIPTION OF THE PREFERRED INVENTION

Figure 1:
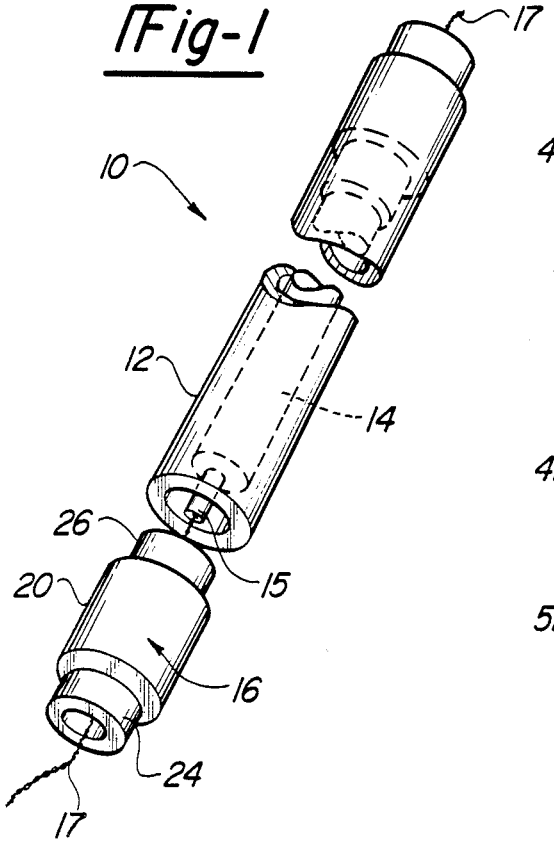
FIG. 1 is an exploded perspective view of the present invention.

With reference to FIG. 1, the shielded lamp unit of the present invention is shown generally at 10. Lamp unit 10 includes a substantially tubulr-shaped protective member or shield 12 enclosing a quartz or quartz-type lamp 14. In the preferred embodiment, member 12 is constructed of quartz.

The lamp 14 has terminals 15 which are connected by leads 17 to an electrical source. It is within the intended scope of the present invention to use other means of connecting the quartz lamp to an electrical source, the disclosed means of connection being illustrative only.

Support or end caps 16 are positioned at each end of member 12 to support the lamp in spaced concentric relationship to the inner walls of the member 12. Support caps 16 have a substantially tubular body 20 with a longitudinal bore 22 extending therethrough. Bore 22 is divided into two sections 23 and 25 with section 23 having a greater diameter than section 25 for receipt of lamp 14. In the disclosed embodiment, the electrical lead 17 extends through portion 25 for connection with an electrical source (not shown). The adjoining ends of portions 23 and 25 form an inner concentric ledge 29 within bore 22. When properly positioned, lamp 14 abuts against the ledge 29 of each end cap 16 preventing longitudinal movement of lamp 14 within member 12.

A concentric annular flange 26 extends from each end cap 16. Flange 26 has an inner diameter substantially equal to the inner diameter of bore 22 and an outer diameter slightly less than the inner diameter of member 12. Annular flange 26 is received by member 12 to align lamp 14 and to prevent contaminants from entering member 12 and depositing on the surface of lamp 14. Annular flange 26 receives lamp 14 to keep lamp 14 in spaced concentric relationship to the inner wall of member 12.

Figure 4:
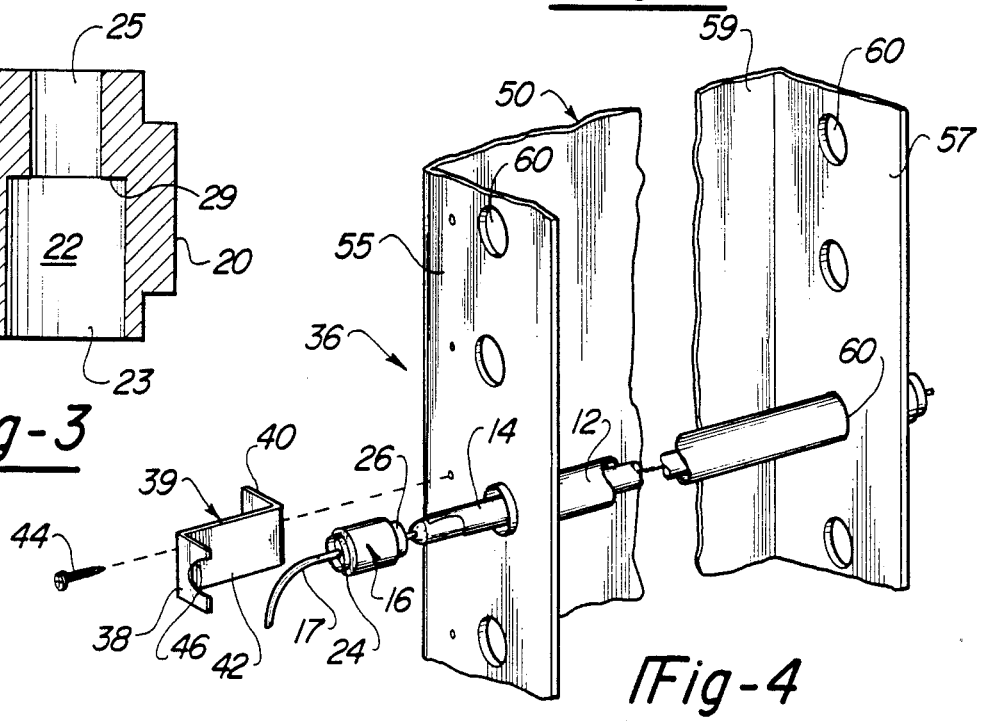
FIG. 4 is an exploded perspective view of the lamp unit mounted between insulating walls.

In the preferred embodiment of the present invention, a further flange 24 is provided opposite flange 26 to facilitate mounting of the lamp unit 10. With reference to FIG. 4, a preferred mounting means 36 is provided having a housing 50 and bracket 39. Bracket 39 includes a body portion 42 and at least one end or foot portion 38 and, in the preferred embodiment, a second end or foot portion 40 which is parallel to but oppositely directed from the first foot 38. Foot 38 has a semicircular slot 46 configured to receive annular flange 24. The inner diameter of slot 46 corresponds to the outer diameter of flange 24 to provide a tight fit. As disclosed, foot 40 receives a fastening means, such as for example a machine screw 44, to mount bracket 36 to housing 50. To facilitate rapid mounting of unit 10, mounting brackets 36 are made of resilient material, such as for example spring steel. The spring steel can be biased to receive the opposed end caps 16 and support unit 10 therebetween.

Housing 50 has two opposed walls 55 and 57 joined by a panel 59. Each wall 55 and 57 has a series of openings 60 for receipt of at least one lamp unit 10. Unit 10 protrudes through the walls 55 and 57 and is retained in position by brackets 39 located on the protrusion side of each wall 55 and 57. Panel 59 acts as a resflector to reflect the heat from unit 10 in the direction of the object to be heated. In the preferred embodiment, cooling air is circulated along the protrusion side of walls 55 and 57 to keep the ends of lamp units 10 below 600° F.

Figure 2:
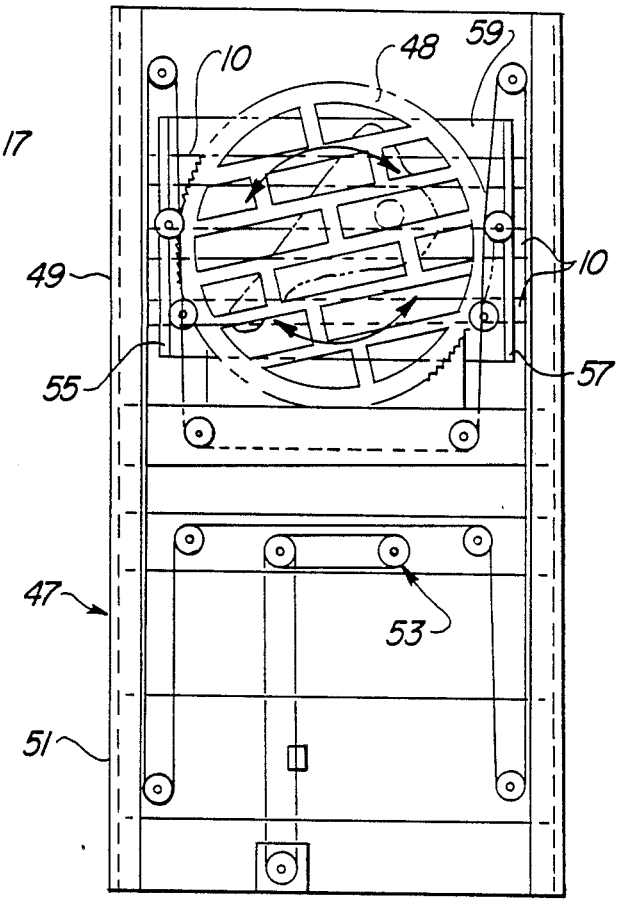
FIG. 2 is an automatic oven showing the shielded lamp unit installed in an oven.
Figure 3:
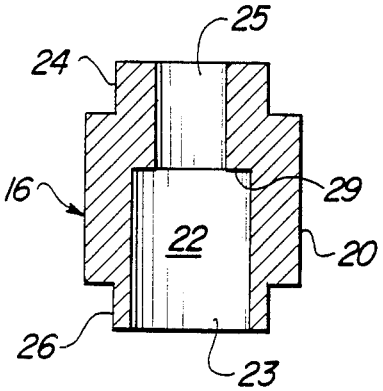
FIG. 3 is a cross-sectional view of the support cap.

With reference to FIG. 2, an automatic oven of the type disclosed in applicant's U.S. Pat. No. 3,882,766 is partially shown at 47. Applicant's U.S. Pat. No. 3,882,766 is included herein by reference. Oven 47 includes upper and lower stations 49 and 51 respectively and a food retainer 48 which is vertically positionable between stations 49 and 51. A pulley system 53 controls the movement of retainer 48.

In operation, retainer 48 is first positioned in the lower station where the food to be prepared can be loaded. The retainer 48 is then raised into the upper section between the horizontally arranged lamp units 10. As illustrated, lamp units 10 are positioned on both sides of and closely adjacent to retainer 48. In this position, retainer 58 and the food are exposed to substantially all of the available heat provided by units 10.

As should be understood, the invention disclosed in FIG. 1 has application beyond that disclosed in the preferred embodiment. As is apparent, the invention is readily available for all applications of quartz-type lamps. The protective shield 12 provides an easier means of handling the fragile quartz-type lamp 14. Therefore, it is within the scope of the intended invention to provide not only a shielded quartz-type lamp for cooking or processing food, but also a protective shield for use in all applications of quartz-type lamps. Further, the intended scope of the present invention contemplates the use of the protective shield on any type of quartz-type lamp of any geometric shape.

The foregoing is a description of the preferred embodiment of the present invention and should not be taken in a restrictive sense but only as describing the underlying concepts of the present invention. Many modifications may be made without departing from the spirit and scope of this invention. Therefore, this invention should be limited only by the following claims.

What is claimed is:

1. An improved high intensity cooking unit for automatically broiling and self-basting foods including a rotatable food retainer and a drive system for continuously rotating the food retainer between heating elements, said food retainer being constructed to expose said food to said heating elements as said food retainer rotates, said improvement comprising:

a plurality of quartz lamps;

a plurality of elongated, substantially tubular members shaped complementary to the lamps having an inner diameter greater than the outer diameter of each respective lamp, with each of said lamps being positioned substantially concentrically within a respective one of said tubular members;

support means having first and second laterally spaced faces, a longitudinal bore extending through said faces and first and second opposed substantially annular flanges concentric with said bore extending from each face, one of said flanges having an outer diameter slightly smaller than the inner diameter of said tubular member such that the one flange is readily received by the tubular member;

said longitudinal bore having two concentric portions, the first portion extending inwardly from said first face for receipt of said lamp and the second portion having a smaller diameter than said first portion extending inwardly from said second face, the two portions meeting to form an abutment against which said lamp ends abut;

substantially parallel opposed vertical walls each having a plurality of openings therethrough for receipt of said tubular members, such that said tubular members protrude through each of said walls with said support means being mounted at each end of the tubular members from the opposite faces of said walls, whereby said walls protect the opposite ends of said tubular member, said lamp and said support means from high temperatures; and resilient retainers mounted upon said walls biasing said support means inwardly toward said tubular member to seal the interior of said tubular member from contaminants;

whereby said foods are positioned closely adjacent the heating elements to utilize the intense heat generated from said quartz lamps without damage to said quartz lamps.

2. The high intensity cooking unit of claim 1, wherein said tubular member is made of quartz.

3. The high intensity cooking unit of claim 1, wherein said support means are made of ceramic material.

* * * * *